United States Patent [19]

Suzuki et al.

[11] Patent Number: 4,502,512

[45] Date of Patent: Mar. 5, 1985

[54] METHOD FOR TREATING A WEFT YARN UPON STOPPAGE OF A SHUTTLELESS LOOM AND DEVICE FOR EFFECTING THE SAME

[75] Inventors: Hajime Suzuki, Anjo; Yoshimi Iwano, Higashiura; both of Japan

[73] Assignee: Seisakusho Kabushiki Kaisha Toyoda Jidoshokki, Kariya, Japan

[21] Appl. No.: 512,913

[22] Filed: Jul. 12, 1983

[30] Foreign Application Priority Data

| | | | |
|---|---|---|---|
| Jul. 21, 1982 | [JP] | Japan | 57-125843 |
| Jul. 21, 1982 | [JP] | Japan | 57-125844 |
| Jul. 23, 1982 | [JP] | Japan | 57-127732 |
| Jul. 24, 1982 | [JP] | Japan | 57-128332 |

[51] Int. Cl.[3] ..... D03D 47/30

[52] U.S. Cl. ..... 139/116; 139/435

[58] Field of Search ..... 139/1 R, 1 E, 435, 116

[56] References Cited

U.S. PATENT DOCUMENTS 3,805,850 4/1974 Duynhoven et al. ..... 139/1 E 4,407,334 10/1983 Brouwer ..... 139/435

FOREIGN PATENT DOCUMENTS 2935507 3/1981 Fed. Rep. of Germany ..... 139/1 E

*Primary Examiner*—Henry S. Jaudon

*Attorney, Agent, or Firm*—Brooks, Haidt, Haffner & Delahunty

[57] ABSTRACT

A method for treating a weft yarn upon stoppage of a shuttleless loom comprising:

stopping a shuttleless loom based on a stop signal;

bringing the warp yarns in an open shed condition between the time of switching off said shuttleless loom and the time of restarting said shuttleless loom, so that a weft yarn which has been picked just before the stoppage of said shuttleless loom is released from its crossed condition by said warp yarns;

automatically inserting a pushing out device into a clearance between said weft yarn and a preceding weft yarn to separate said weft yarn from a cloth; and removing said separated weft yarn.

23 Claims, 36 Drawing Figures

METHOD FOR TREATING A WEFT YARN UPON STOPPAGE OF A SHUTTLELESS LOOM AND DEVICE FOR EFFECTING THE SAME

TECHNICAL FIELD OF THE INVENTION

The present invention relates to a method for treating a weft yarn after stoppage of a shuttleless loom, especially an air jet loom or a water jet loom. The present invention also relates to a device for effecting the method.

PRIOR ART

In order to speed up a weaving operation, air jet looms and water jet looms are utilized wherein measured weft yarns are picked into open sheds formed between upper and lower warp yarns by means of jet nozzles. In such a high speed weaving loom, stoppage of the weaving loom causes a remarkable loss of production efficiency compared to that in a conventional weaving loom, since the weaving speed is high. Accordingly, it is preferable when a jet loom is utilized that the time duration wherein the weaving loom is stopped is as short as possible.

In a jet loom, a weft yarn is inserted into an open shed by means of fluid, such as air or water, and not by means of a shuttle which has been common in a conventional weaving loom. Accordingly picking faults may occur more easily than in a conventional weaving loom utilizing a shuttle. More specifically, in a jet loom, picking faults, such as a so called weft yarn supply fault wherein a weft yarn cannot be supplied form a jet nozzle or a so called transmission fault wherein a weft yarn cannot reach the selvage located opposite a jet nozzle while it is supplied from the jet nozzle, may occur easily.

Further, it should be noted that the operating timing of a jet loom which operates at a high speed is selected in such a manner that, even if its driving system is switched off just after a picking fault is detected, the loom does not stop until after about one cycle operation, due to inertia force, from the detection of the picking fault in order to avoid damage of parts of the loom by excessive deceleration. As a result, in a conventional jet loom, when the loom is switched off upon detection of a picking fault, the succeeding picking cycle takes place before stoppage of the loom. Therefore, it is necessary to remove not only the weft yarn which caused the picking fault but also the weft yarn was picked in the succeeding cycle, by returning the loom in a reverse direction. In this case, since the weft yarn which was picked in the cycle just after the picking fault has been subjected to a beating operation as is a usual weft yarn, and it is securely held by the cloth, its removal is not easy and the removing operation is very troublesome.

In addition, when a warp yarn (including a yarn for selvage) is cut or when an operating switch of a loom is manually turned off, the loom stops after about one cycle operation due to inertia force, for a reason similar to that described above. If due to inertia force the weft yarn which has been picked during the operation is required to be removed in order to prevent barré, the removal is not easy for a reason similar to that described above.

OBJECT OF THE INVENTION

An object of the present invention is to provide a method by which a faultily picked weft yarn, upon the stoppage of a shuttleless loom, can be readily and automatically removed.

Another object of the present invention is to provide a device suitable for effecting such a method.

SUMMARY OF THE INVENTION

According to the present invention, a method for treating a weft yarn upon stoppage of a shuttleless loom is provided. The method comprises:

the step of stopping a shuttleless loom upon receipt of a stop signal;

the step of bringing the warp yarns to an open shed condition between the time of switching off said shuttleless loom and the time or restarting said shuttleless loom, so that the weft yarn which has been picked just before the stoppage of said shuttleless loom is released from is crossed condition by said warp yarns;

the step of automatically inserting a pushing out device into a clearance between said weft yarn and the preceding weft yarn to separate said weft yarn from the cloth; and the step of removing said separated weft yarn.

According to the method of the present invention, the weft yarn which has been picked during the cycle after the occurrence of a picking fault, i.e., the cycle just before the stoppage of the loom, is removed first. Then, the weft yarn which was picked during the cycle before the above-described cycle and which caused the picking fault is removed according to the method of the present invention. As a result, the treatment of a weft yarn after stoppage of a shuttleless loom can be completely and substantially automatically performed.

The applicant of the present invention previously proposed a method for treating a faulty yarn (i.e., a faultily picked weft yarn, a broken warp yarn, etc.), by which in a jet loom which has been stopped due to the faultily picking of the weft yarn, breakage of the warp yarn can readily be repaired. The proposed method is applicable to a jet loom wherein a measured weft yarn is picked into an open shed formed between upper and lower warp yarns by means of one or more jet nozzles. The method comprises braking the loom upon detection of an emergency stop signal while the picking is prevented from occurring before the stoppage of the loom, and thereafter, returning the jet loom to a condition wherein the faultily picked weft yarn which caused the emergency stop signal can be readily treated while the supply of a weft yarn is prevented.

When the method of the present invention is required to be performed together with the previously proposed method, only the weft yarn which has been faultily picked is automatically separated from the cloth, since the picking of the weft yarn after the occurrence of the picking fault is prevented, and thus, the faultily picked weft yarn can be easily removed so as to re-start the loom.

Furthermore, the applicant of the present invention previously proposed a method for easily removing a faultily picked weft yarn in a jet loom. The method comprises temporarily deenergizing the weft cutter disposed at a side of the jet nozzle upon the detection of the faulty weft picking by means of a weft detecting device, stopping the operation of the loom while the weft yarn continues to extend from the jet nozzle, and removing the faultily picked weft yarn together with weft yarn which has not been cut.

When the present invention is performed together with this method for removing a faultily picked weft yarn, the faultily picked weft yarn is completely or substantially automatically separated from the cloth according to the present invention, and then, the faultily picked weft yarn is removed together with the weft yarn which has not been cut. As a result, the faultily picked weft yarn can completely be and substantially automatically removed.

It should be noted that the above-described previously proposed two methods may be performed together with the method of the present invention.

When the present invention is applied to a weaving operation wherein cloth with close textile weave, such as corduroy, is woven, sometimes there is a problem that the weft yarn cannot be separated if the pushing out device is operated only once.

In order to obviate such a problem, the present invention may be carried out in such a way that at least a some of the steps wherein said pushing out device is moved are repeated several times.

When the textile weave is close, and it is difficult for the pushing out device to be inserted into the clearance provided only by opening the warp yarns to permit springing out of the latest picked weft yarn having the above-described step, wherein the pushing out device is slid along the cloth from the cloth toward the cloth fell and is inserted into the clearance, is repeated several times. Because of the repetition of the step, the weft yarn is mechanically pushed, and the insertion of the pushing out device becomes possible. Furthermore, due to the repetition of the step, the holding force of the warp yarns is lessen, and therefore, the succeeding removal step can be smoothly performed.

Contrary to this, when the weft yarn is firmly held by thw warp yarns and it is difficult for the weft yarn to be separated therefrom, the step, wherein the pushing out device is moved apart from the cloth, is repeated several times. The repetition of the step vibrates the holding portions where the warp yarns are held by the weft yarns, and as a result, the holding force is lessened, and the removal of the weft yarn can be easily done.

BRIEF DESCRIPTION OF THE DRAWINGS

The present invention will now be explained in detail with reference to the accompanying drawings, wherein.

DETAILED DESCRIPTION OF THE INVENTION

In the present invention, the fact is taken into consideration that a clearance is formed between the last picked weft yarn, and the cloth because of a slight movement of the weft yarn even after the beating operation, whereupon the weft yarn is made free by bringing the warps into an open shed condition.

Figure 3A:
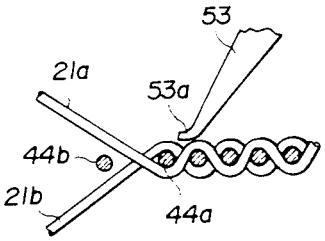
FIGS. 3*a* and 3*b* are side views for explaining the principle of the present invention.
Figure 3B:
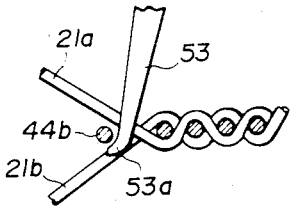

More specifically, according to the present invention, the warps of the loom are brought into an open shed condition, and as illustrated in FIG. 3*a*, the front end 53*a* of the pushing out device 53 is brought into slight contact with the surface of the cloth and is displaced along the cloth towards the cloth fell for a distance between that equal to one or two weft yarns and some centimeters. Since the upper and lower warps 21*a* and 21*b* are open so as to bring the weft yarn 44*b* which was picked latest into a free condition, a clearance is formed between the weft yarn 44*b* and the weft yarn 44*a* which is woven in the cloth. Accordingly, the front end 53*a* of the pushing out device 53, which has been in contact with and has been displaced along the surface of the cloth, can enter into the small clearance formed between the cloth and the weft yarn 44*b* (see FIG. 3*b*) due to the pressing down force. As the pushing out device 53 is further displaced in such a direction that it departs from the cloth, the weft yarn 44*b* is separated from the cloth. Accordingly, the weft yarn can be removed by means of an appropriate taken up means or by means of manual operation.

It is preferable that the front end of the pushing out device 53 be slid along the surface of the cloth for a distance between that equal to one or two weft yarns and some centimeters. Due to its construction, the front end of the pushing out device 53 can surely be inserted into the small clearance between the cloth and the weft yarn 44*b* which has been picked latest so that it is assured that the weft yarn 44*b* which has been picked latest can be pushed out, even when the position of the cloth fell is varied in the moving direction of the pushing out device due to the change of the textile weave or when the position of the cloth fell is slightly varied along the width of the same cloth. Accordingly, when the above-described variations are small, the distance over which the pushing out device slides can be very small.

Figure 1:
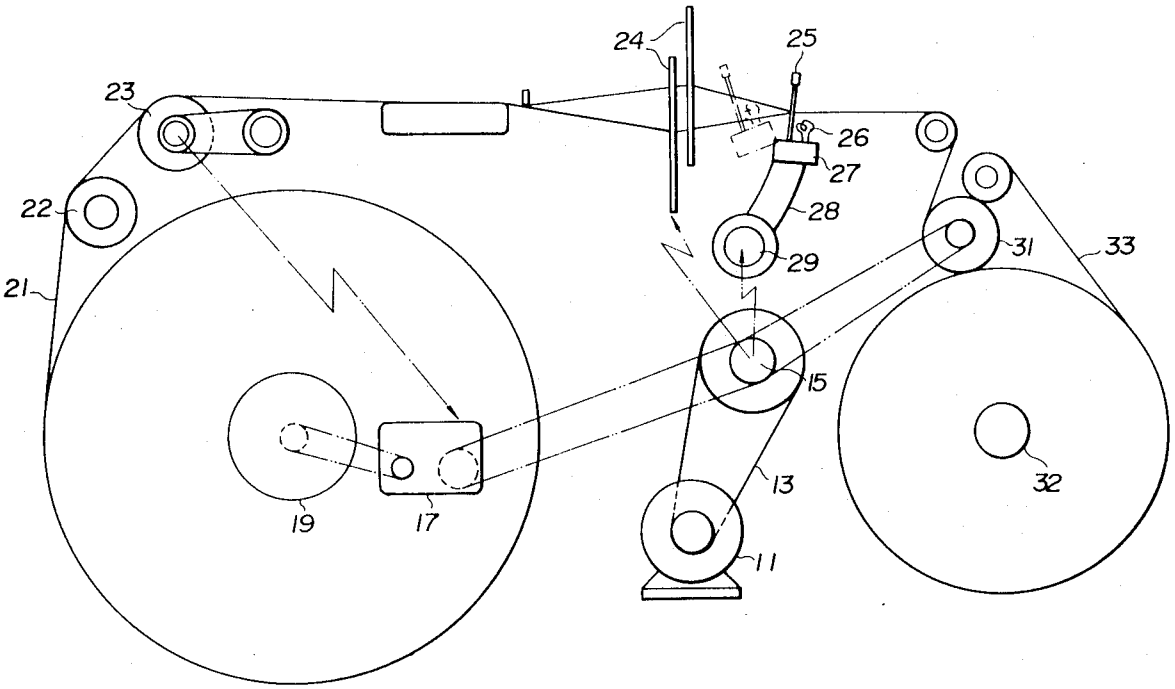
FIG. 1 is a schematic side view of a driving system of an air jet loom according to the present invention.
Figure 2:
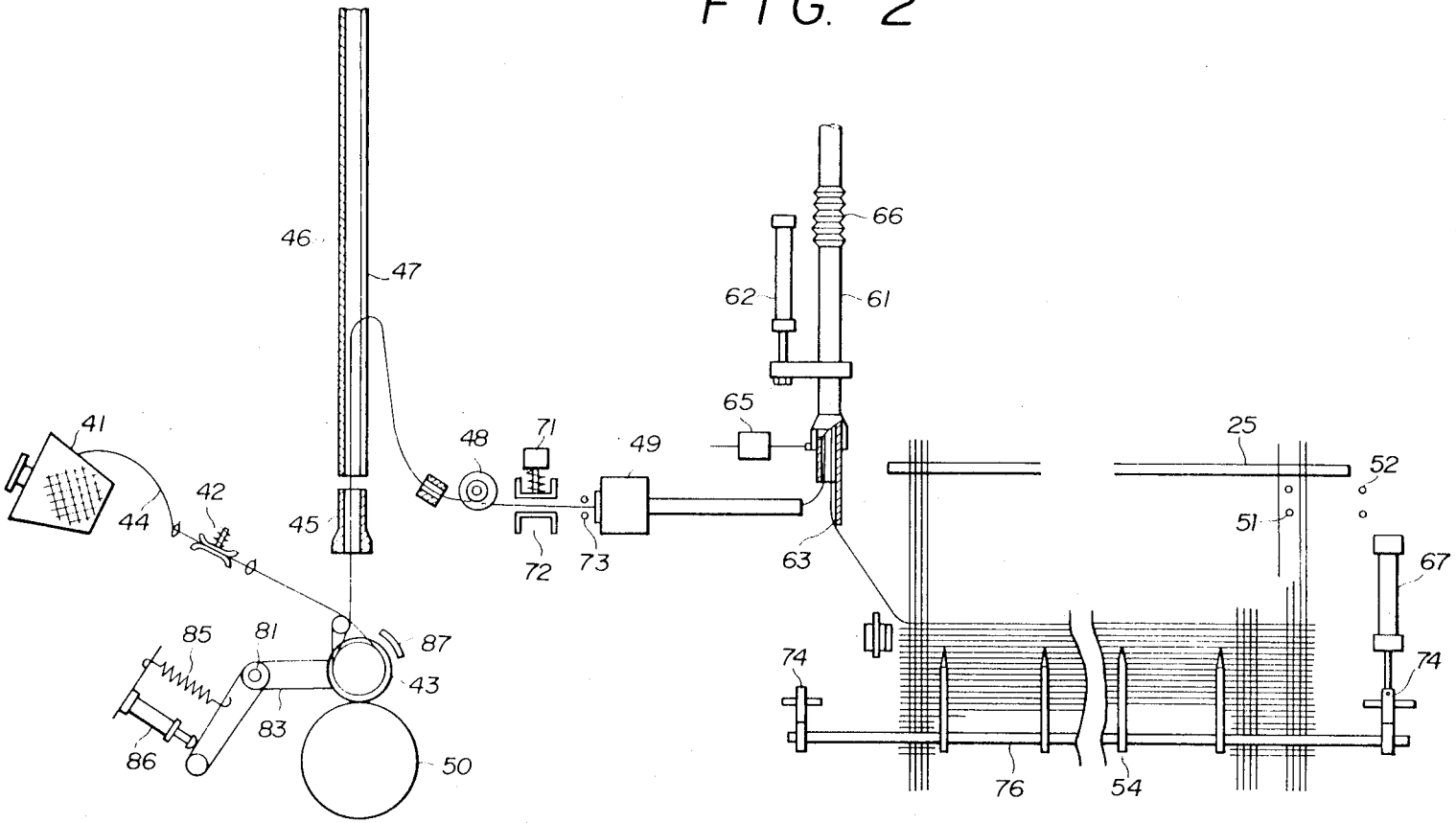
FIG. 2 is a schematic plan view of an embodiment of the present invention.

The apparatus for performing the above-described method will now be explained referring to FIGS. 1, 2 and 4. FIG. 1 is a side view illustrating the driving system of an air jet loom of the present invention. Similar to a conventional loom, driving power is transmitted to a crankshaft 15 from a driving motor 11 through a transmission means, such as a V belt 13. The crankshaft 15 drives a yarn beam 19 through a speed change gear 17 so as to let off warp yarns 21, and frictionally drives a winding roller 32 by means of a surface roller 31 so as to take up cloth 33. The speed reduction ratio of said speed change gear 17 is adjusted in accordance with the displacement of a tension roller 23, so that the tension in the warps let off through a back roller 22 is adjusted to a predetermined value. The crankshaft 15 lifts and lowers heald frames 24, so as to give the warp yarns 21 a predetermined shedding motion. A rocking shaft 29 supports a slay 27 via a slay sword 28, and the slay 27 is provided with reeds 25 and filling guide 26. The crankshaft 15 moves the reeds 25 and the filling guides 26 between the position illustrated by a solid line and the position illustrated by a broken line via the rocking shaft 29, and as a result, the reeds 25 beat up the picked weft yarn. The above-described construction is similar to that of a conventional air jet loom.

The weft picking mechanism will now be explained with reference to FIG. 2. A weft yarn 44 is withdrawn from a cheese 41 through a tenser 42 by means of a feed roller 43, and then it is stored in a pool pipe 46 by means of an air nozzle 45. A measuring drum 50 rotates in synchronism with the crankshaft 15 (FIG. 1) and frictionally drives the feed roller 43, so that a predetermined length of weft yarn 44 is measured by means of the feed roller 43 in accordance with the rotation of the crankshaft 15 (FIG. 1) and is fed to the air nozzle 45. The pool pipe 46 has an axially extending slit 47 formed at one side thereof, so that the the weft yarn accumulated in the pool pipe 46 can be readily taken out through the slit 47. A measuring and accumulating mechanism, such as disclosed in Japanese Patent Application Laid-open No. 57-16946 or No. 56-58028, wherein a weft yarn is wound around a measuring drum and the withdrawal of the weft yarn from the measuring drum is controlled, may be utilized in place of the above-described measuring and accumulating mechanism comprising a feed roller and a pool pipe.

A gripper 48 is disposed at a position between the pool pipe 46 and a main air jet nozzle 49, so that the supply of weft yarn from the pool pipe 46 to the main air jet nozzle 49 is controlled. The main air jet nozzle 49 ejects compressed air in synchronism with the rotation of the crankshaft 15 (FIG. 1) and picks the weft yarn 44 into the open shed formed by the upper and lower warps, and then, the reeds 25 beat up.

Detectors 51 and 52 of an adequate type, such as a mechanical type or fluid type, are disposed at a position adjacent to the selvage opposite the main air jet nozzle and detect whether or not the weft yarn 44 is surely supplied from the main air jet nozzle 49, in accordance with a conventionally known method, for example, the method disclosed in Japanese Patent Publication No. 54-21475.

A suction nozzle 61 of a conventionally known type is disposed at a position between the main air jet nozzle 49 and the selvage and creates suction force by means of compressed air. The suction nozzle 61 has a suitable reciprocating member 62, such as a pneumatic cylinder or an electromagnetic solenoid, connected thereto. As the reciprocating member 62 operates, the front end of the suction nozzle 61 can move between a position remote from the passage of the weft yarn ejected from the main air jet nozzle 49 and a position adjacent to the weft yarn passage.

The suction nozzle 61 has a guide plate 63 mounted at the front end thereof in such a manner that when the suction nozzle 61 moves backwardly, the guide plate 63 is out of the weft yarn passage and when the suction nozzle 61 moves forwardly, the guide plate 63 crosses the weft yarn passage.

The suction nozzle 61 has a bellows type flexible coupling 66 connected at the rear end thereof to ensure smooth movement of the suction nozzle 61. Please note that the suction nozzle 61 and the guide plate 63 integrally fixed thereto are not limited to those movable along the length of the weaving loom and may be of other types, for example, those swingable in a vertical direction.

Reference numeral 65 denotes a valve which controls the ejection of air flow into the suction nozzle 61. An auxiliary gripper 72 is disposed at a position between the main air jet nozzle 49 and the gripper 48 and is operated by means of an electromagnetic solenoid 71 or an pneumatic cylinder (not shown). Reference numeral 73 denotes a feeler of a photo-electric type or fluid type.

The feed roller 43 is rotatably supported at the front end of an arm 83 which is supported swingably about a pin 81. A spring 83 is connected to an end of the arm 83 opposite to the side where the feed roller 43 is supported, so that the arm is normally urged against the front end of a piston of the pneumatic cylinder 86 or an armature of the electromagnetic solenoid. Accordingly, the feed roller can be either in a position where it is urged against the measuring drum 50 so as to be frictionally driven or in a position where it is separated from the measuring drum 50 so as not to be frictionally driven by means of the operation of the spring 85 and the pneumatic cylinder 86. Reference numeral 87 denotes a brake shoe which engages with the feed roller 43 when the latter is separated from the measuring drum 50.

Figure 6A:
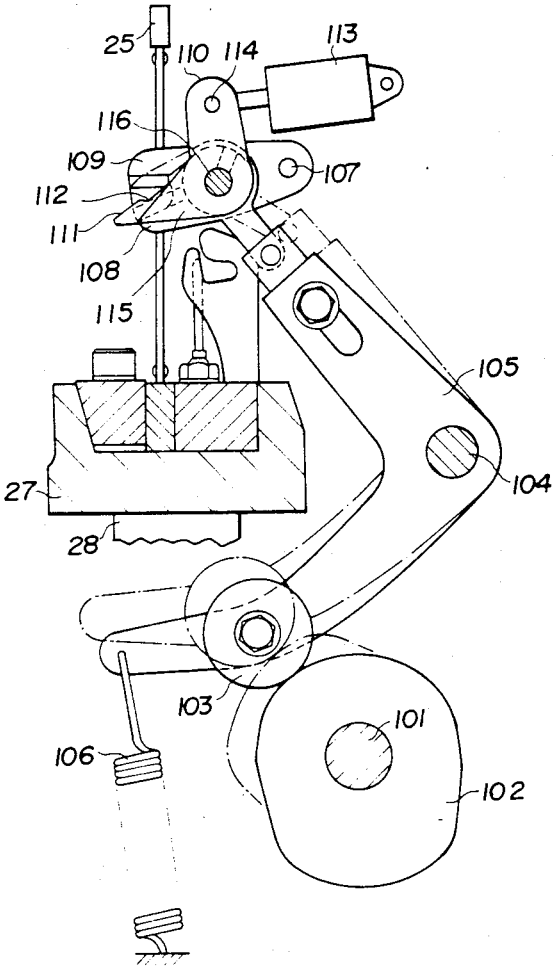
FIGS. 6*a* and 6*b* are side views of a weft yarn cutter disposed on the apparatus illustrated in FIG. 1.
Figure 6B:
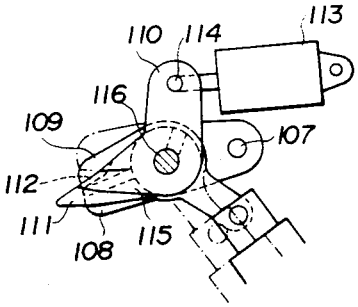
Figures 7A, 7B, 7C:
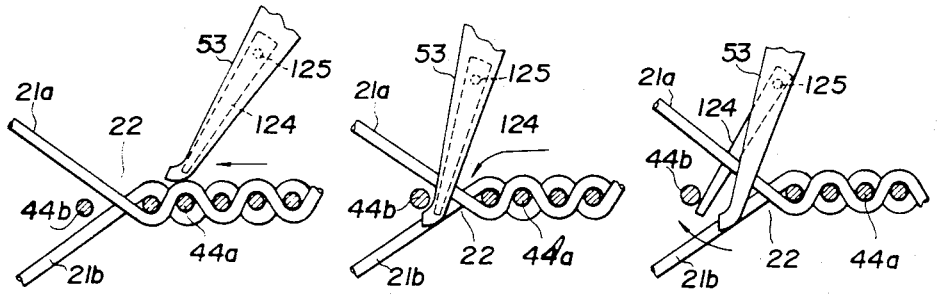
FIGS. 7*a*, 7*b* and 7*c* are side views for explaining the principle of the present invention.

The machine frame has a weft yarn cutter mounted thereon as illustrated in FIGS. 6*a* and 6*b*. In the weft yarn cutter, a cam 102 is fixed to a shaft 101 which rotates in synchronism with the rotation of the crankshaft 15 (FIG. 1). A lever 105 is swingable about a shaft 104, and a cam follower 103 supported by the lever 105 is urged to the cam 102 by means of a spring 106. The lever is swung by means of the cam 102, and accordingly, a movable blade 109 is swung about a pin 116. Due to the above-described construction, during the normal operation, a weft yarn is cut by means of a fixed blade 108 and the movable blade 109 as illustrated in FIG. 6*a*, while it is held in a holding recess 112 of a guide 11. Contrary to this, when a stop signal is emitted, the armature of the electromagnetic solenoid 113 moves backwardly, and a cutting preventing member 110, which is connected to the armature by means of a pin 114, is swung clockwise about the pin 114 (see FIG. 6*b*). The cutting preventing member 110 and a preventing guide 115 which is formed in an L shape are aligned with each other, and as a result, the weft yarn is not held in the recess 112, and it is not cut between the movable blade 109 and the fixed blade 108.

The construction of the pushing out device will now be explained with reference to FIGS. 4*a* through 4*c*. Both ends of a beam member 76 having a length longer than the cloth width are supported by a pair of vertical rods 74, and the beam member 76 is disposed at a position above or below the cloth. The beam member 76 has one arm member 54 located at a position corresponding to the center of the cloth width or a plurality of arm members 54 located at positions spaced along the cloth width, in accordance with the cloth width, textile weave, material of the yarns, and the stroke of the arm member or members in a lengthwise direction of the weaving loom. The arm member 54 has a pushing out device 53 swingably connected to the front end thereof by means of a pin 55. When the front end of a bolt 78, which is screwed to a bracket 77 integrally extending from the arm member 54 located near the selvage, engages with a boss 74*a* formed on the vertical rod 74, the arm member 54 moves integrally with the vertical rod 74. A spring 79 urges the front end of the bolt 78 towards the boss 74*a*. When the bolt 78 is apart from the boss 74*a*, an adequate pressing force is exerted on the arm member 54 by means of the spring 79. A bolt 57 is screwed to a bracket 56 which is integrally formed on each arm member 54 so that the front portion of the bolt 57 presses the back surface of the pushing out device 53 which is formed in an L shape. A spring 58 urges the pushing out device 53 to the bolt 57.

When the the distance between the arm member 54 located near the selvage and the vertical rod 74 is large, an auxiliary arm member (not shown) having a shape similar to that of the arm member 54 may be secured to the beam member 76 located near the vertical rod, a bracket 77 may be extended from the auxiliary arm member, and a spring 79 may be disposed between the auxiliary arm member and the vertical rod.

The vertical rod 74 is supported swingably about a supporting shaft 75, and the lower end of the vertical rod 74 is connected to a piston rod 68 of a fluid pressure cylinder 67, such as a pneumatic cylinder, by means of a pin 69. The fluid pressure cylinder 67 is supported by the machine frame by means of a pin 64. The fluid pressure cylinder may be disposed at each side of the machine frame of the weaving loom or at one side as illustrated in FIG. 2.

The method for treating a weft yarn, after a stoppage, of the present invention will now be explained.

As the heald frames 24 are subjected to a shedding operation, weft yarns 44 are picked into the open shed formed between the upper and lower warp yarns. More specifically, in FIG. 2, the weft yarn 44 is withdrawn from the cheese 41 through the tenser 42 and is measured by means of the feed roller 43 which rotates in synchronism with the rotation of the crankshaft 15 (FIG. 1), and thereafter, it is accumulated in the pool pipe 36 by means of the air nozzle 45 (FIG. 2). The operations of the gripper 48, which is disposed at a position between the pool pipe 46 and the main air jet nozzle 49, and the main air jet nozzle 49 are controlled in synchronism with the rotation of the crankshaft 15 (FIG. 1), so that the weft yarn, which has been accumulated in the pool pipe 46, is picked into the open shed formed between the upper and lower warp yarns 21 by means of compressed air ejected from the main air jet nozzle 49.

The detectors 51 and 52, which are disposed at positions near the selvage opposite the main air jet nozzle 49, investigate whether or not a weft yarn is picked while the warp yarns are closed (i.e., crank angle of 250 to 300 degrees). When a picking fault occurs, wherein a weft yarn which has been picked into the open shed does not reach the selvage located opposite the main air jet nozzle 49 because of any one of a number of reasons, the detector 51 or 52 emits a faulty picking signal. Based on the faulty picking signal, the motor 11 (FIG. 1) for driving the weaving loom is switched off and the weaving loom continues its operation due to inertia force.

In addition, when the faulty picking signal is emitted, the piston of the reciprocating member 62 is moved forwardly so that the guide plate 63 fixed at the front end of the suction nozzle 61 is located at a position across the weft yarn passage. As a result, the weft yarn which is ejected from the main air jet nozzle 49 after the occurrence of the picking fault is guided by the guide plate 63 to the suction nozzle 61, by which the weft yarn is sucked.

Furthermore, the cutting function of the weft yarn cutter is temporarily deactuated so that the weft yarn which has been faultily picked is permitted to extend from the main air jet nozzle 49. More specifically, as illustrated in FIG. 6*b*, the cutting preventing member 110, which is connected to the armature by means of the pin 115, is swung clockwise about the pin. The cutting preventing member 110 is aligned with the preventing guide 115 which is formed in an L shape. As a result, the weft yarn is not held by the recess 112, and it is not cut between the movable blade 109 and the fixed blade 108.

Accordingly, the weft picking after the emission of the faulty picking signal is prevented, and therefore, the weft yarn extends from the open shed to the main air jet nozzle 49 through the suction nozzle 61.

The weaving loom which has been operating due to the inertia force stops when the warp yarns 21 are substantially in an open shed condition (i.e., crank angle of 300 degrees) after it has operated about one cycle.

Then, preparation for a returning operation takes place. More specifically, main air jet nozzle 49 is deenergized. The gripper 48 is closed, or the auxiliary gripper 72 is closed by the electromagnetic solenoid. Furthermore, the pneumatic cylinder 86 is operated so that the feed roller 43 is separated from the measuring drum 50, and accordingly, the weft yarn supply mechanism is deenergized. Contrary to this, the piston of the reciprocating member 62 is moved backwardly so that the guide plate 63 attached to the front end of the suction nozzle 61 is located away from the weft yarn passage. Under this condition, the driving motor 11 (FIG. 1) is directly rotated in a reverse direction or an auxiliary motor (not shown) which is disposed independent from the driving motor 11 is operated, and the weaving loom is reversely operated for about 480 degrees to an open shed condition wherein the warp yarns 21 are open (at a crank angle of about 180 degrees).

According to the present invention, under the open shed condition, the pushing out device is inserted into the small clearance formed between the weft yarn and the cloth in accordance with a signal for commencing the pushing action, and the weft yarn which has been faultily picked is automatically and mechanically separated from the cloth. The signal for commencing the pushing action may be emitted by means of a timer after elapse of a determined time duration from the emission of the emergency stop signal, such as the faulty weft picking signal, or may be emitted based on a signal from a limit switch or the like by detecting the open shed condition after the reverse operation of the weaving loom, or may be emitted by manually pushing a push button.

Figure 4A:
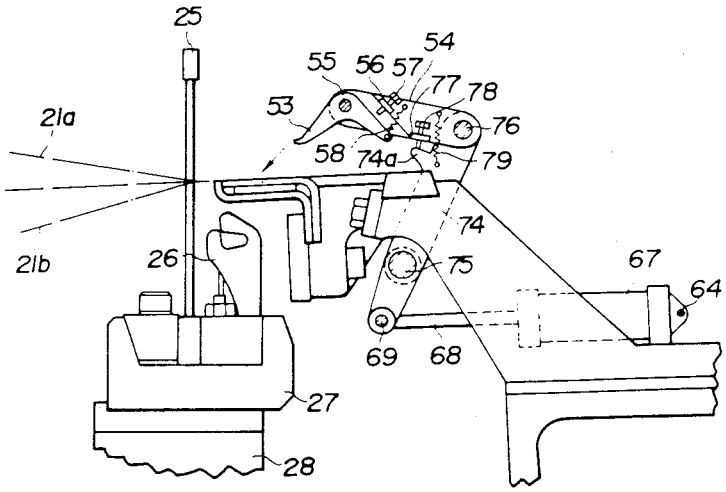
FIGS. 4*a*, 4*b* and 4*c* are side views of an embodiment of the present invention.
Figure 4B:
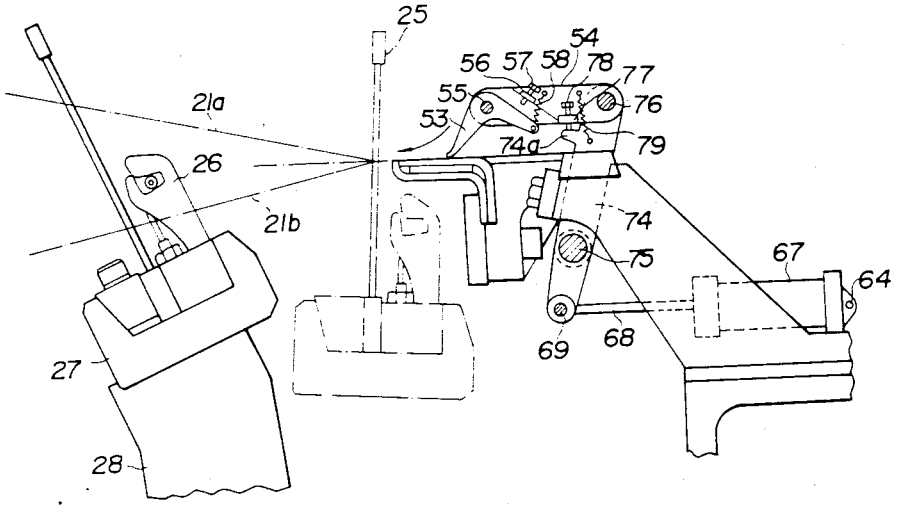

During the normal operation, as illustrated in FIG. 4*a*, the piston rod 68 of the fluid pressure cylinder 67 is extended, and the vertical rod 74 is swung clockwise about the supporting shaft 75. The front end of the bolt 78 engages with the boss 74*a*, and the front end of the bolt 57 engages with the back surface of the pushing out device 53, and accordingly, the front end of the pushing out device 53 is apart from the cloth. Therefore, the pushing out device 53 does not prevent any weaving operation of the jet loom during the normal weaving operation.

Based on the stop signal, the weaving loom stops while the upper and lower warp yarns are stopped in an open shed condition. When the signal for commencing the pushing out action is emitted, the piston rod 68 of the fluid pressure cylinder 67 is retracted. As a result, the vertical rod 74 is swung counterclockwise about the supporting shaft 75. At this time, until the front end of the pushing out device 53 contacts the surface of the cloth (see FIG. 4*b*), all the pushing out devices 53, the arm members 54 and the vertical rod 74 swing in one body. However, when the front end of the pushing out device 53 contacts the surface of the cloth, the lowering movement of the pushing out devices 53 is prevented, and accordingly, the pushing out device 53 is swung about the pin 55 and departs from the bolt 57. As a result, due to the spring force of the spring 58, the front end of the pushing out device 53 contacts the surface of the cloth with a predetermined pressure.

As the piston rod 68 of the fluid pressure cylinder 67 is further retracted and the vertical rod 74 is further swung counterclockwise, the front end of the pushing out device 53 slides over the surface of the cloth with an adequate pressure.

Figure 4C:
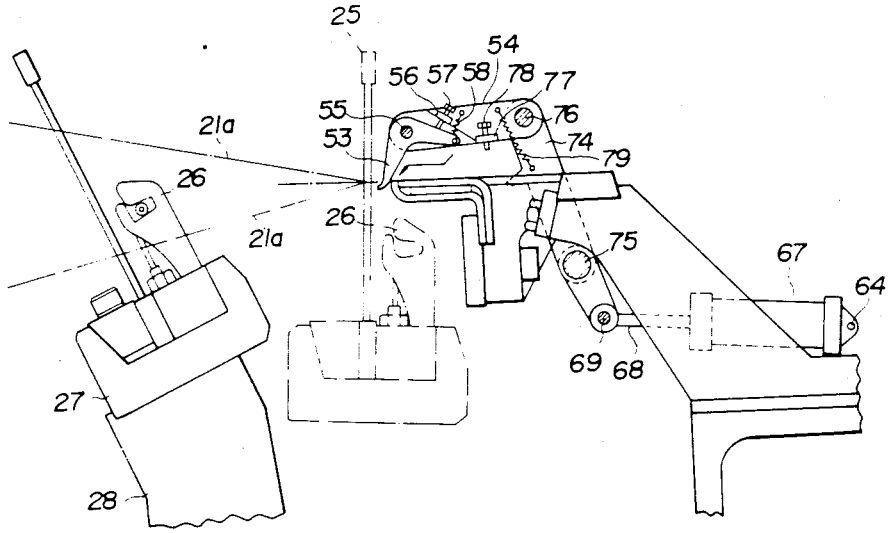

When the front end of the pushing out device 53 reaches the small clearance formed between the weft yarn 44*b* (see FIGS. 3*a* and 3*b*), the front end of the pushing out device 53 enters into the small clearance due to the spring force of the spring 58, and occasionally that of the spring 79 (see FIG. 4*c*). Under this condition, when the piston rod 68 of the fluid pressure cylinder 67 is further retracted, the pushing out device separates the weft yarn 44*b* from the cloth.

The weft yarn which has been separated from the cloth in the foregoing manner is no longer firmly held by the warp yarns, and accordingly, it can be easily removed by means of an adequate take up means, such as a suction nozzle 61, or a manual operation.

After the weft yarn is removed in the manner described above, a switch is automatically or manually turned on, and the weaving loom is returned about 270 degrees to a condition wherein the warps 21 are in an open shed condition and which is suitable for restarting the air jet loom.

Thereafter, the main air jet nozzle 49 is actuated. The electromagnetic solenoid 71 is deenergized, and the auxiliary gripper 72 is open, and in addition, the gripper 48 is brought into the normal operating condition. Further, piston of the pneumatic cylinder 86 is retracted so that the feed roller 43 is urged to the surface of the measuring drum 50 and so that the weft measuring mechanism is brought into an operating condition. Under this condition, the operation of the jet loom is restarted.

In the above-described embodiment, the front end of the pushing out device 53 is slid along the surface of the cloth for a certain distance, so that the front end of the pushing out device 53 can surely be inserted into the small clearance between the cloth and the weft yarn which has been picked latest and so that it is assured that the weft yarn which has been picked latest can be pushed out, even when the position of the cloth fell is varied in the moving direction of the pushing out device due to the change of the textile weave or when the position of the cloth fell is slightly varied along the width of the same cloth. However, when the above-described variations are small, the front end of the pushing out device 53 may directly enter into the small clearance between the cloth and the weft yarn.

Figure 5:
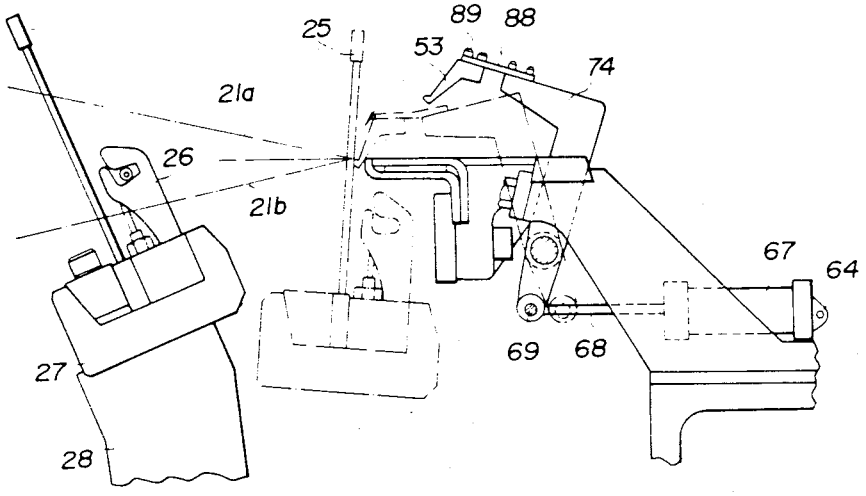
FIG. 5 is a side view of another embodiment of the present invention.

An embodiment of this type is illustrated in FIG. 5. In this embodiment, it is preferable that the pushing out device 53 is connected to the vertical rod 74 by means of a flexible member 88 and that the pushing out device 53 is designed in such manner that its front end first contacts a position slightly entering into the cloth at a slight distance (distance equal to one or two weft yarns) from the cloth fell, and then, the front end of the pushing out device 53 slides over the cloth while the flexible member 88 bends. Thereafter, it enters the small clearance after it moves the above-described small distance.

When the weft yarn 44*b* is firmly held by the warp yarns 21*a* and 21*b* or when the elasticity of the weft yarn is large, it is necessary to enlarge the moving stroke of the pushing out device 53 to separate the weft yarn from the cloth. However, often it is difficult to install a pushing out device with a sufficiently large stroke in a restricted space in a weaving loom. Accordingly, in an embodiment of the present invention illustrated in FIGS. 7*a*, 7*b*, 8*a* and 8*b*, the pushing out device has an auxiliary pushing out device mounted thereon and movable relative thereto. The pushing out device 53 is moved apart from the cloth, and there is no difficulties in separation of the weft yarn 44*b*, because the auxiliary pushing out device 124 is moved relative to the pushing out device 53 so that the weft yarn 44*b* is further separated from the cloth. As a result, the separation of the weft yarn can be easily done, even when the stroke of the pushing out device 53 per se is small.

Figure 8A:
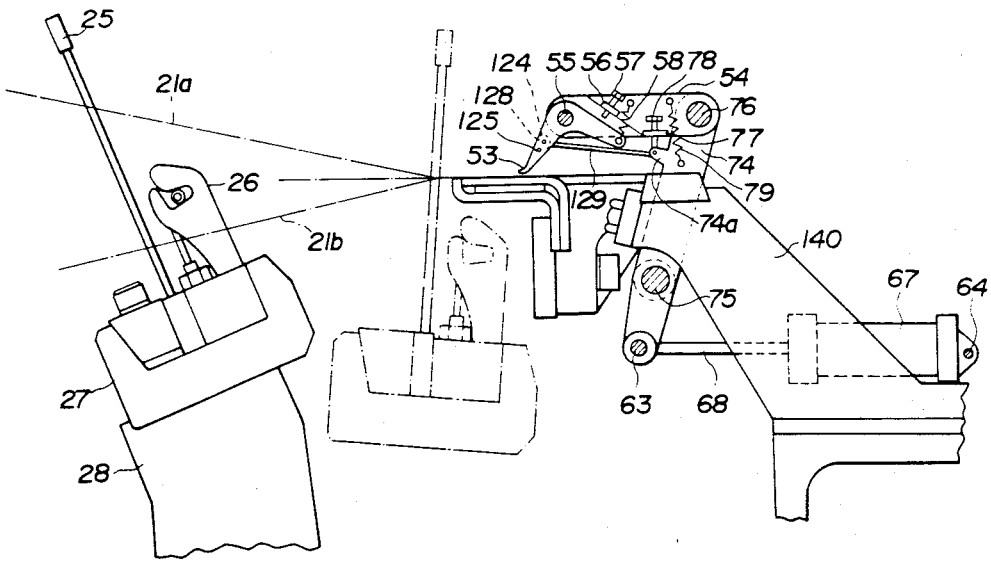
FIGS. 8*a* and 8*b* are side views of still another embodiment of the present invention.

Details of this embodiment will now be explained referring to FIGS. 8*a* and 8*b*. During the normal operation, the piston rod 68 of the fluid pressure cylinder 67 illustrated in FIG. 8*a* is extended, and the vertical rod is swung clockwise about the supporting shaft 75. The front end of the bolt 78 engages with the boss 74*a*, the front end of the bolt 57 engages with the back surface of the pushing out device 53, and the front end of the pushing out device 53 is apart from the surface of the cloth. Accordingly, the pushing out device 53 does not at all prevent the weaving operation during the normal operation.

Based on the emergency stop signal, such as a faulty picking signal, the weaving loom is switched off and stops at a condition wherein the upper and lower warps 21*a* and 21*b* are open. Responsive to a signal for commencing the pushing out operation, the piston rod 68 of the fluid pressure cylinder 67 is retracted.

As the piston rod 68 of the fluid pressure cylinder 67 is retracted, the vertical rod 74 is swung counterclockwise about the supporting shaft 75. At this time, until the front end of the pushing out device reaches the surface of the cloth, the pushing out device 53, the arm member 54 and the vertical rod 74 swing in one body. However, once it contacts the cloth, the lowering movement of the pushing out device 53 is prevented, and the pushing out device swings about the pin 55, and therefore, the pushing out device 53 departs from the bolt 57. As a result, due to the spring force of the spring 58, the front end of the pushing out device 53 contacts the surface of the cloth with a predetermined pressure.

As the piston rod 68 of the fluid pressure cylinder 67 is further retracted and the vertical rod 74 is further swung counterclockwise, the front end of the pushing out device 53 slides over the surface of the cloth with an adequate pressure.

Figure 8B:
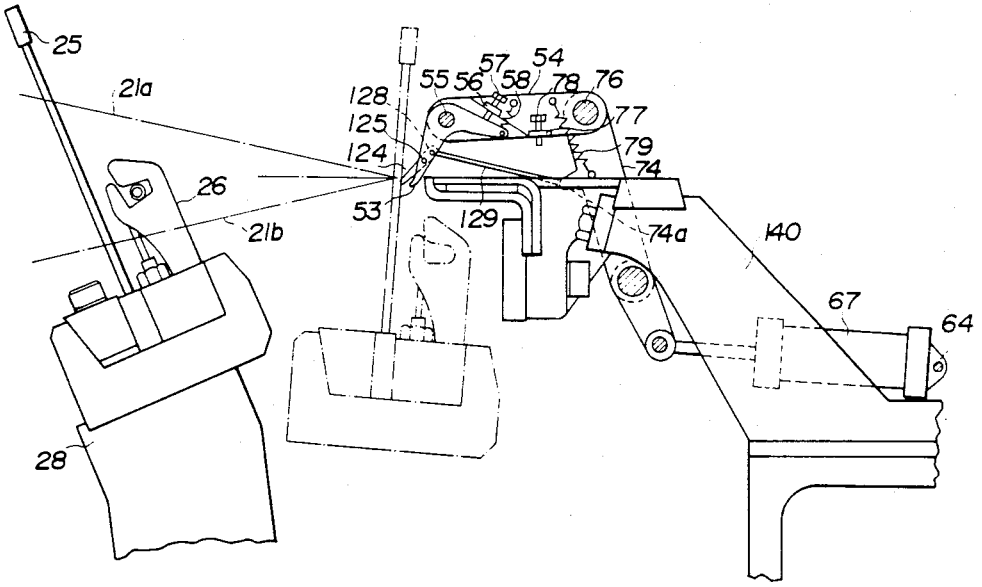

When the front end of the pushing out device 53 reaches the small clearance formed between the cloth and the weft 44*b* (see FIGS. 8*a* and 8*b*) which has been picked latest, the front end of the pushing out device 53 enters into the small clearance by way of the spring force of the spring 58, and in addition occasionally by way of the spring force of the spring 79 (see FIG. 8*b*).

When the piston rod 68 of the fluid pressure cylinder 67 is further retracted while the pushing out device is inserted into the small clearance, the weft yarn 44*b* is separated from the cloth by the pushing out device 53.

When the weft yarn 44*b* is firmly held by the cloth or when the elasticity of the weft yarn 44*b* is large, it is sometimes necessary to excessively enlarge the moving stroke of the pushing out device to separate the weft yarn from the cloth only by means of the separating operation of the pushing out device 53. According to the present embodiment of the present invention, the pushing out device has an auxiliary pushing out device 124 mounted thereon and movable relative thereto. When the piston rod 68 of the fluid pressure cylinder 67 is fully retracted, the upper end of the auxiliary pushing out device 124 is pulled by the vertical rod 74 and the connecting rod 129. The combination movement of the pushing out device 53 and the auxiliary pushing out device 124 achieves an effect substantially the same as that achieved by increasing the stroke of the pushing out device. As a result, the weft yarn which has been faultily picked can be easily separated from the cloth.

Figure 9:
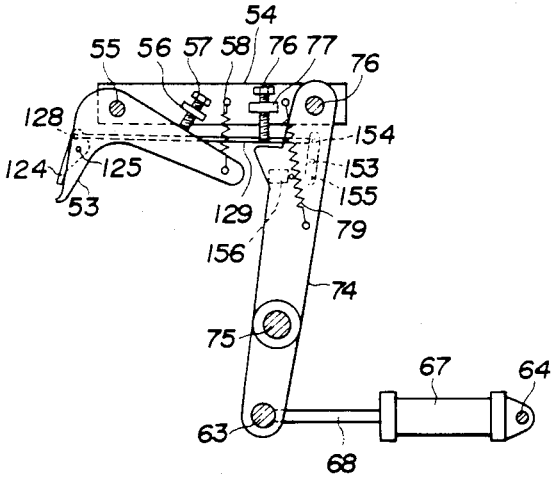
FIG. 9 is a side view of a further embodiment of the present invention.

Another apparatus of the present invention will now be explained with reference to FIG. 9. In the apparatus illustrated in FIGS. 8*a* and 8*b*, the auxiliary pushing out device 124 is moved by the reciprocating movement of the fluid pressure cylinder for effecting reciprocating movement of the pushing out device. Contrary to this, in the apparatus illustrated in FIG. 9, a reciprocating member, such as an armature of an electromagnetic solenoid 156 or piston rod of a fluid pressure cylinder, is separately disposed, and the auxiliary pushing out device is actuated by the reciprocating member. More specifically, the vertical rod 74 rotatably supports a lever 155 by a pin 153, and the lower end of the lever 155 is connected to the reciprocating member, such as the armature of the electromagnetic solenoid 156 or the piston rod of the fluid pressure cylinder. The upper end of the lever 155 is connected to a connecting rod 129 via a pin. The connecting rod 129 is connected to the auxiliary pushing out device 124 by means of a pin 128. Accordingly, as the reciprocating member is reciprocated, the auxiliary pushing member 124 is swung about the pin 125 by means of the lever 155 and the connecting rod 129. The operating timing of the auxiliary pushing out device is selected similar to that of the pushing out device of the above-described embodiment, and the pushing out device is inserted into the small clearance formed between the weft yarn 44*b* and the cloth, and can be controlled by a computer or limit switches. In addition, it is also possible to securely separate the weft yarn by reciprocatingly operating the auxiliary pushing out member and reducing the weft yarn holding force due to the resulting vibration effect.

Figure 10A:
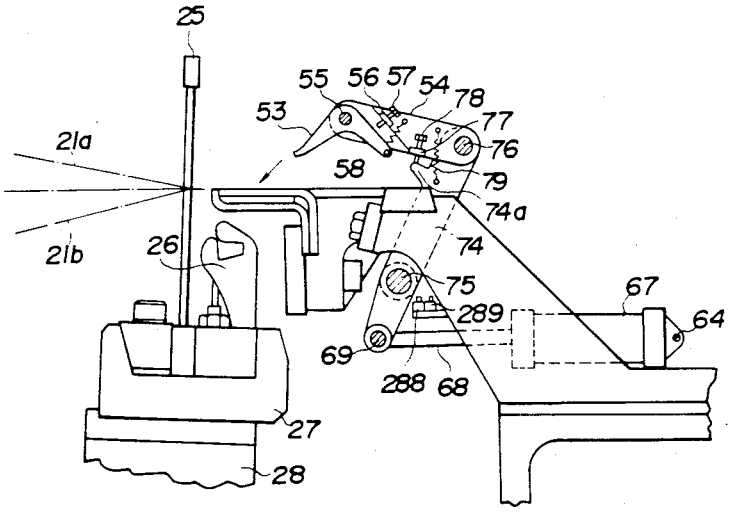
FIGS. 10*a*, 10*b* and 10*c* are side views of another embodiment of the present invention.
Figure 10B:
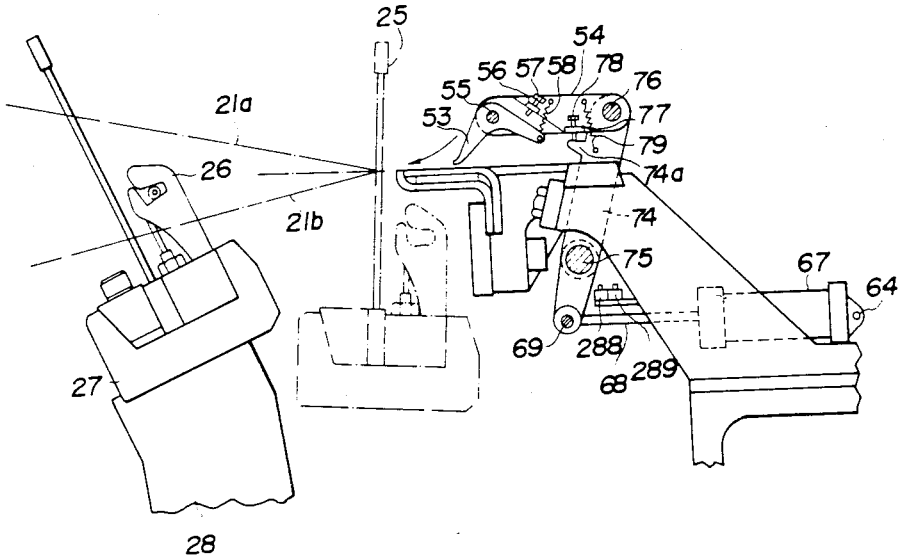
Figure 10C:
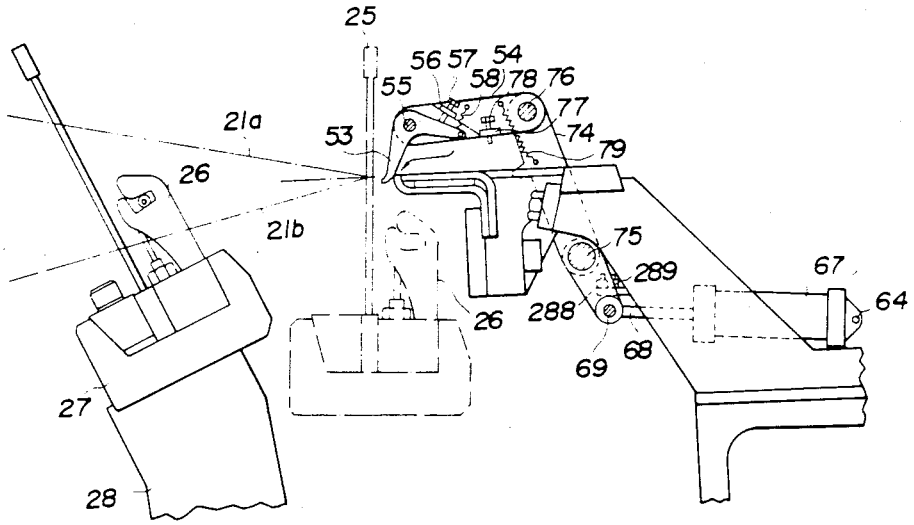

Another embodiment will now be explained referring to FIGS. 10*a* through 10*c*. Limit switches 288 and 289 are disposed on the frame to control the moving direction of the piston rod 68 of the fluid pressure cylinder 67. When the dog (not shown) attached to the vertical rod 74 hits the limit switch 289 while the piston rod 68 of the fluid pressure cylinder 67 is moved backwardly, the piston rod changes its moving direction and moves forwardly. When said dog hits the limit switch 288, the piston rod moves backwardly again. The above-described movements may repeat several times, if necessary. In addition, control by means of a computer is applicable in place of the control by means of the limit switches 288 and 289 which control has been explained above.

When a cloth with close textile weave, such as corduroy, is woven, sometimes there is a problem that the pushing out device cannot enter the small clearance because the clearance is too small. When the piston rod 68 of the fluid pressure cylinder 67 is moved backwardly and hits the limit switch 289, the piston rod changes the moving direction and moves forwardly again. As a result, the front end of the pushing out device 53 is slid along the cloth in a direction opposite to that described above. When said limit switch 288 is hit, the pushing out device 53 again moves along the cloth towards the cloth fell in the first direction.

Once the pushing out device 53 enters into the small clearance, the clearance is widen by the pushing out device 53, and therefore, the front end of the pushing out device 53 securely enters the small clearance at the next sliding operation even if the pushing out device is withdrawn from the clearance.

If the textile weave is close and the clearance is too small to be entered by the pushing out device as described above, the weft yarn 44*b* is pushed in such a direction that it departs from the cloth fell and the clearance becomes enlarged by the front end of the pushing out device 53 at the first sliding step. As a result, the clearance is widened when the pushing out device reaches next, and at this time, the pushing out device can readily enter the clearance. The resistance imparted to the weft yarn by the pushing out device while the pushing out device moves backwardly is very small and the clearance which has been widened is never narrowed by the backward movement of the pushing out device 53.

When the piston rod 68 of the fluid pressure cylinder 67 is further retracted, the pushing out device 53 separates the weft yarn from the cloth.

When the weft yarn 44*b* is firmly held by the cloth, the step for separating the weft yarn 44*b* from the cloth is repeated as in the above-described case. The repetition of the step gives a vibration effect to the weft yarn and the warp yarns 21*a* and 21*b* firmly holding the former, and as a result, the holding force is slightly lessened, and the weft yarn can be easily removed from the cloth.

Another compact pushing out device will now be explained with reference to FIGS. 11*a* and 11*b*, and 12*a* and 12*b*.

Figure 11A:
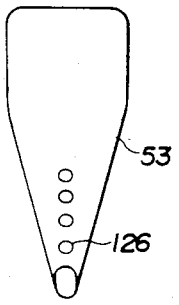
FIGS. 11*a* and 11*b* are an elevation view and a cross sectional side view of a still further embodiment of the present invention.
Figure 11B:
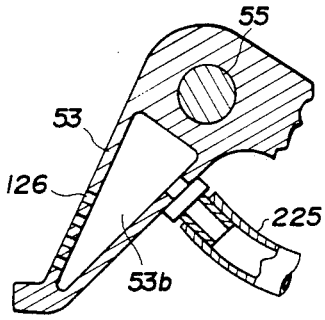
Figure 12A:
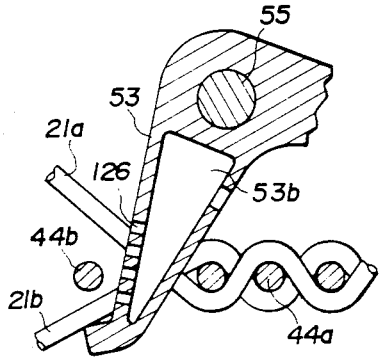
FIGS. 12*a* and 12*b* are cross sectional side views of a further embodiment of the present invention.
Figure 12B:
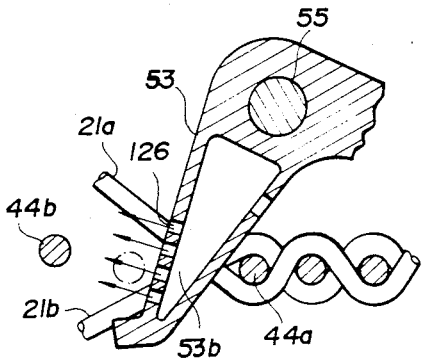

As illustrated in FIG. 11*a*, the pushing out device 53 is converged at the lower side thereof. As illustrated in FIG. 11*b*, the pushing out device has a cavity 53*b* formed therein, and the cavity 53*b* is communicated with the outside through nozzles 126 for ejecting compressed air. The nozzles 126 for ejecting compressed air are designed in such manner that they face the weft yarn 44*b* held by the pushing out device 53 as will be explained later. In addition, the cavity 53*b* also communicates with a compressed air source (not shown) through a flexible conduit 225 for supplying compressed air. Compressed air is supplied from the compressed air source to the cavity 53*b* formed in the pushing out device 53, so that compressed air is ejected through the nozzles 126 for ejecting compressed air to the weft yarn 44*b* (see FIG. 12*b*). Because of the mechanical pushing force caused by the ejected compressed air and fluid vibration caused by the compressed air, the holding force between the warp yarns and the weft yarn is lessen. The combined operation of the pushing out device 53 and the ejection of compressed air achieves an effect similar to that achieved by a device wherein the stroke of the pushing out device is increased. As a result, the weft yarn which has been faultily picked can be easily separated from the cloth.

In the foregoing explanation, the nozzles for ejecting compressed air are formed in the pushing out device, however, the nozzles for ejecting compressed air may be disposed separate from the pushing out device.

Another construction of the pushing out device will now be explained referring to FIGS. 13*a* through 13*c*. The construction is similar to that explained with reference to FIG. 2. More specifically, both ends of a beam member 76 having a length longer than the cloth width are supported by a pair of vertical rods 74, and the the beam member 76 is disposed at a position above or below the cloth. The beam member 76 has one arm member 54 located at a position corresponding to the center of the cloth width or a plurality of arm members 54 located at positions spaced along the cloth width, in accordance with the cloth width, textile weave, material of the yarns, and the stroke of the arm member or members in a lengthwise direction of the weaving loom. The arm member 54 located at substantially the center of the cloth width has a pushing out device 53 swingably connected to the front end thereof by means of a pin 55. The arm members 54 spaced from that located at the center have auxiliary pushing out devices swingably connected to the front ends thereof by means of pins 55.

Figure 13A:
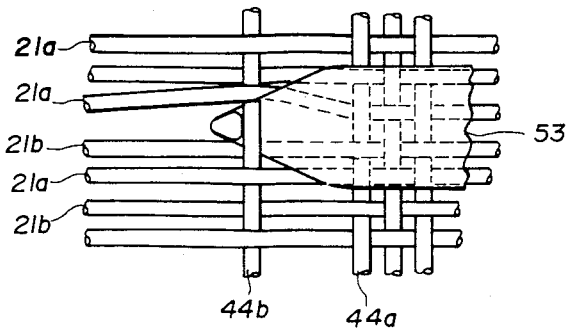
FIGS. 13*a* through 13*c* illustrate another embodiment of the present invention, FIG. 13*a* being a plan view, FIG. 13*b* an elevation view, and FIG. 13*c* cross sectional side view.
Figure 13B:
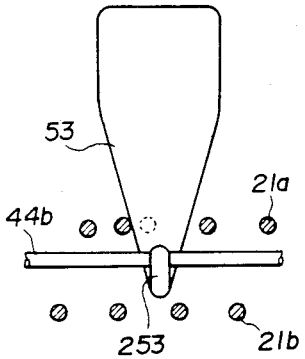
Figure 13C:
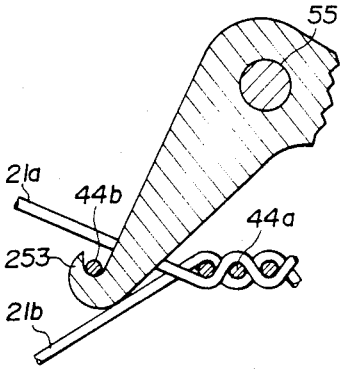
Figure 14A:
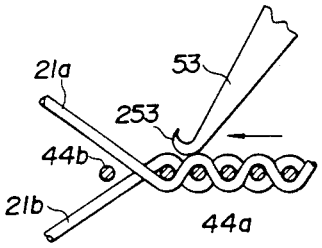
FIGS. 14*a*, 14*b*, 14*c* and 14*d* are side views explaining the principle of the present invention.
Figure 14B:
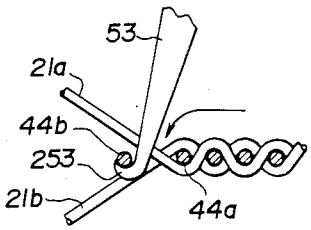
Figure 14C:
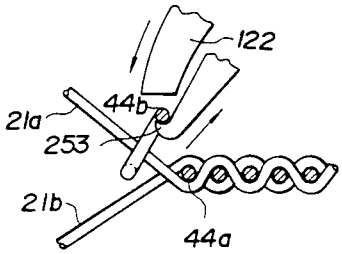
Figure 14D:
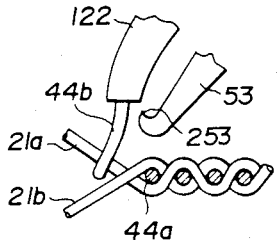

As illustrated in FIGS. 13*a* and 13*b*, the pushing out device 53 has a base portion thicker than the gap between adjacent upper warps 21*a* and is converged at the lower side thereof. The front end 253 of the pushing out device 53 is bent upward in a hook shape, so that the hook shaped end 253 can hold a weft yarn 44*b*. The auxiliary pushing out devices have a shape similar to that of the pushing out device 53 except that the front ends thereof are straight and are not formed in a hook shape.

Referring to FIGS. 14*a*–14*d*, a weft sucking device 122 is rotatably supported on the beam member 76 at a position corresponding to the pushing out device 53. The weft sucking device 122 communicates with a suitable suction source, so that the front end of the weft sucking device can suck weft yarn. The right side of the weft sucking device 122 is connected to the right side of the arm member corresponding thereto by means of an electromagnetic solenoid (not shown). Accordingly, when the armature of the electromagnetic solenoid is retracted, the front end of the weft sucking device 122 is near the weft yarn which is held by the pushing out device 53, and when the armature is extended, the weft sucking device moves away from the pushing out device 53.

In the foregoing explanation, the weft sucking device is movable relative to the pushing out device 122. However, the weft sucking device may be fixed as long as there is no danger that the weft sucking device will collide with the reeds 53 when the pushing out device is moved in a pushing out direction.

Figure 15A:
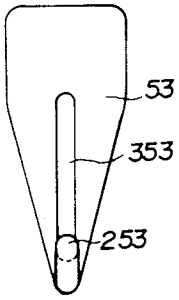
FIG. 15*a* and 15*b* are an elevation view and a cross sectional side view of a still further embodiment of the present invention.
Figure 15B:
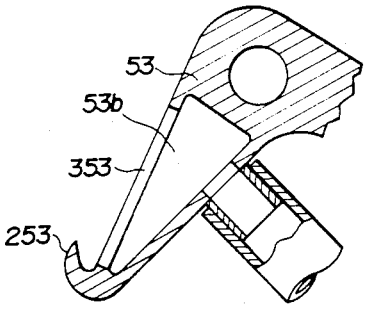

In the foregoing explanation, the weft sucking device 122 is disposed separate from the pushing out device 25. However, the weft sucking device may be formed in the pushing out device. An example of such an embodiment will now be explained with reference to FIGS. 15*a* and 15*b*. The pushing out device 53 has a cavity 53*b* formed therein, and the cavity 53*b* communicates with the outside through a sucking nozzle 53*a*. The sucking device 122 is designed in such manner that it faces the weft yarn 44*b* held by the pushing out device 53 as it does in the above-explained embodiment. In addition, the cavity 53*b* also communicates with a vacuum source (not shown) through a flexible conduit.

A still other embodiment will now be explained. The embodiment can easily and surely remove the weft yarn which has been separated from the cloth in a manner similar to that described above.

Figure 16:
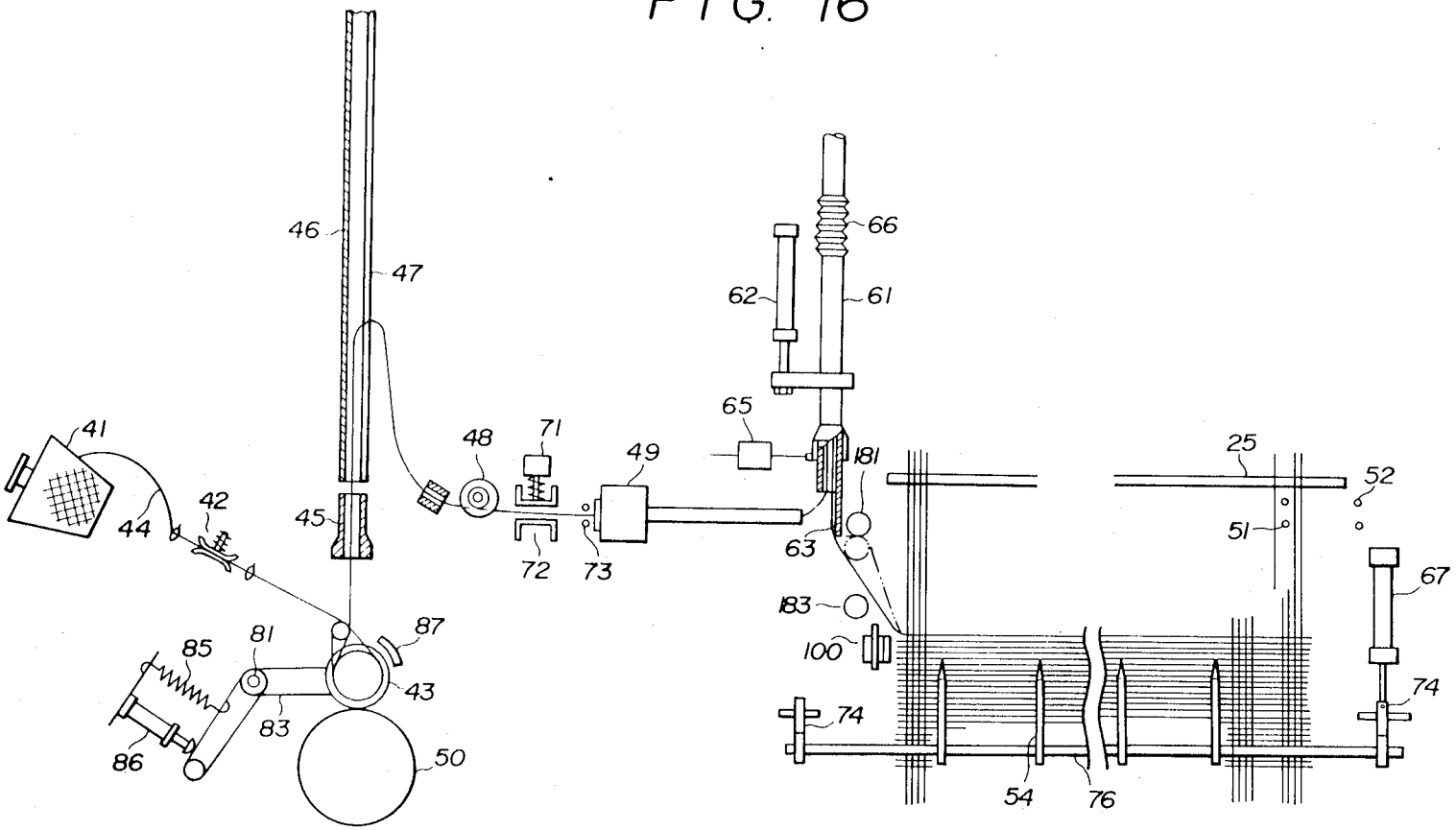
FIG. 16 is a schematic plan view of another embodiment of the present invention.
Figure 17A:
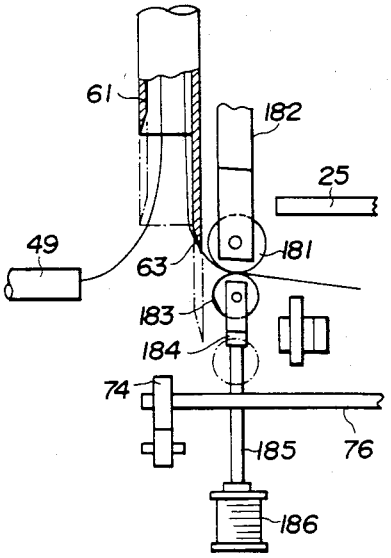
FIGS. 17*a* and 17*b* are a plan view and a side view, respectively, of a still another embodiment of the present invention.
Figure 17B:
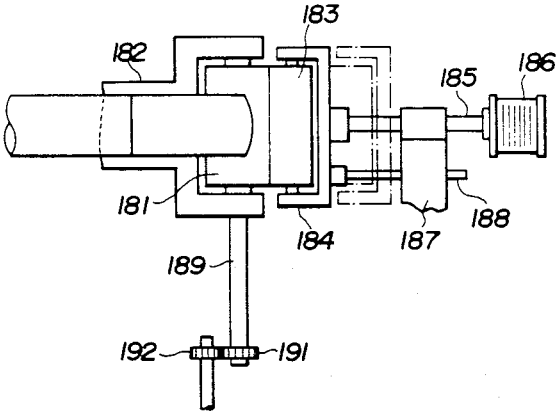

In FIG. 16, a pair of rollers 181 and 183, which constitute one embodiment of the auxiliary take up member of the present invention, are disposed at a position between the suction nozzle 61 and the selvage. As illustrated in FIG. 17*b*, the driving roller 181 is rotatably supported on a bracket 182 attached to the machine frame and is driven by a drive motor (not shown) via gears 191 and 192 and drive shaft 189. The roller 183 is rotatably supported on a bracket 184. The shaft 185 fixed to the bracket 184 is connected to an electromagnetic solenoid or a fluid pressure cylinder, and the shaft 185 is moved along a guide 187 by means of the electromagnetic solenoid 186. Therefore, the roller 183 can be located at a position where it is pressed against the driving roller 181 and a position where it is apart from the driving roller 181. Reference numeral 188 denotes a guide for preventing oscillating movement.

In the present embodiment, the pressing roller 183 of the pair of rollers 181 and 183, which constitute the auxiliary take up member, is pressed against the driving roller 181 by means of the electromagnetic solenoid 186, so that the weft yarn is held between the rollers 181 and 183 and is fed into the suction nozzle 61. Accordingly, the weft yarn can be securely removed even though the capability of the suction is not excessively enhanced.

Furthermore, the driving roller of the rollers 181 and 183 constituting the auxiliary take up member may be of a movable type. In this case, the driving roller is designed in such a manner that the driving force can be smoothly transmitted to the driving roller by connecting the driving motor to the driving power source by means of a flexible coupling.

Figure 18:
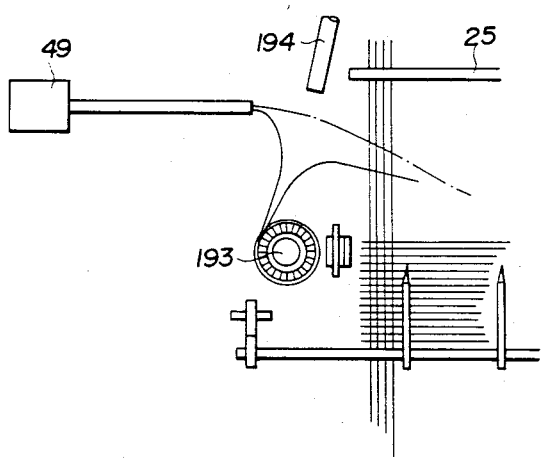
FIG. 18 is a plan view of a still further embodiment of the present invention.

Various alterations are possible to the auxiliary take up member of the present invention. One example is illustrated in FIG. 18, wherein the main take up member is a waste roller 193 and the auxiliary take up member is a nozzle 194 for ejecting compressed air. The nozzle 194 for ejecting compressed air ejects compressed air toward the waste roller 193 so as to feed the weft yarn to the waste roller 193.

Further, the main take up member may be a suction nozzle or waste roller which is similar to that described above, and an auxiliary take up member constructed with a link mechanism may be disposed near the main take up member, so that the weft yarn to be removed is brought to the main take up member by means of the auxiliary take up member.

In the above explanation, the repair of the faultily picked weft yarn is exemplified. However, the present invention is also applicable to repair of a broken warp yarn or selvage, or stoppage of the air jet loom due to manual operation.

The above-described suction nozzle utilizes suction force created by the ejector effect of compressed air. However, other suction nozzles, not only those utilizing the ejector effect but also those which communicates with a suction source, can be used.

According to the present invention, weft yarn can be surely removed after stoppage of a jet loom, and the removal of the weft yarn can be completely and substantially automatically performed.

What is claimed is:

1. A method for treating a weft yarn in a cloth upon stoppage of a shuttleless loom comprising:

stopping said shuttleless loom based on a stop signal;

bringing the warp yarns in an open shed condition between the time of switching off said shuttleless loom and the time of restarting said shuttleless loom, so that a weft yarn which has been picked just before the stoppage of said shuttleless loom is released from its crossed condition between said warp yarns;

automatically inserting a pushing out device into a clearance between said weft yarn and the preceding weft yarn to separate said weft yarn from the cloth; and removing said separated weft yarn.

2. A method for treating a weft yarn upon stoppage of a shuttleless loom according to claim 1, wherein a weft yarn is prevented from being picked within the time duration from the emission of said stop signal to the stoppage of said loom.

3. A method for treating a weft yarn upon stoppage of a shuttleless loom according to claim 1, wherein said loom is stopped without causing cutting of said weft yarn after emission of said stop signal so that said weft yarn extends from a main nozzle.

4. A method for treating a weft yarn upon stoppage of a shuttleless loom according to claim 1, wherein said pushing out device is slid along said cloth towards the cloth fell after emission of said stop signal, said pushing out device is inserted into said clearance between said weft yarn which has been picked just before the stoppage and said cloth, so that said weft yarn is separated from said cloth.

5. A method for treating a weft yarn upon stoppage of a shuttleless loom according to claim 4, wherein said steps of sliding said pushing out device from the cloth to the cloth fell and for inserting said pushing out device into said clearance between said weft yarn and said cloth are repeated several times.

6. A method for treating a weft yarn upon stoppage of a shuttleless loom according to claim 1, wherein the removal of said separated weft yarn is effected by means of a suction nozzle.

7. A method for treating a weft yarn upon stoppage of a shuttleless loom according to claim 1, wherein a plurality of said pushing out devices are disposed along the width of said cloth at a predetermined distance.

8. A method for treating a weft yarn upon stoppage of a shuttleless loom according to claim 1, wherein at least a part of said step wherein said pushing out device is moved is repeated several times.

9. A method for treating a weft yarn upon stoppage of a shuttleless loom according to claim 8, wherein said pushing out device is moved into and out of engagement with the cloth several times.

10. A device for separating a weft yarn in the fell of a cloth upon stoppage of a shuttleless loom in which the cloth is being woven, comprising:

a beam member extending along the cloth width; and at least one pushing out device attached to said beam member;

said pushing out device being movable in the lengthwise direction of said cloth from a position spaced away from said cloth to a position within said fell of the cloth between the last picked weft yarn and said cloth for separating said weft yarn from said cloth.

11. A device for treating a weft yarn upon stoppage of a shuttleless loom according to claim 10, wherein said pushing out device has an auxiliary pushing out device mounted thereon movably relative thereto.

12. A device for treating a weft yarn upon stoppage of a shuttleless loom according to claim 10, which further comprises a nozzle for ejecting compressed fluid on to said last picked weft yarn as it is separated from said cloth by means of said pushing out device.

13. A device for treating a weft yarn upon stoppage of a shuttleless loom according to claim 12, wherein said nozzle for ejecting compressed fluid is formed in said pushing out device.

14. A device for treating a weft yarn upon stoppage of a shuttleless loom according to claim 13, wherein said compressed fluid is compressed air.

15. A device for treating a weft yarn upon stoppage of a shuttleless loom according to claim 10, wherein said pushing out device has a weft yarn engaging portion formed at the front end thereof, and which further comprises a weft sucking member disposed for sucking said last picked weft yarn after it has been separated from said cloth.

16. A device for treating a weft yarn upon stoppage of a shuttleless loom according to claim 15, wherein said weft sucking member is formed in said pushing out device.

17. A device for treating a weft yarn upon stoppage of a shuttleless loom according to claim 15, wherein said weft sucking member is separately formed from said pushing out device.

18. A device for treating a weft yarn upon stoppage of a shuttleless loom according to claim 15, wherein said pushing out device has a base portion whose width is greater than the distance between adjacent warp yarns of said cloth, and a front end portion whose width is smaller than the distance between said adjacent warp yarns, said pushing out device converging from its said base portion to its said front end, said front end being formed in a hook shape.

19. A device for treating a weft yarn upon stoppage of a shuttleless loom according to claim 10, which further comprises a main weft take up member and an auxiliary take up member disposed adjacent to a main jet nozzle of said loom, said main take up member for removing said weft yarn separated from said cloth, and said auxiliary take up member being disposed to progressively feed said weft yarn to said main take up member.

20. A device for treating a weft yarn upon stoppage of a shuttleless loom according to claim 19, wherein said main take up member is a suction nozzle.

21. A device for treating a weft yarn upon stoppage of a shuttleless loom according to claim 19, wherein said main take up member is a waste roller.

22. A device for treating a weft yarn upon stoppage of a shuttleless loom according to claim 19, wherein said auxiliary take up member comprises a pair of rollers, said pair of rollers being capable of engagement with and disengagement from each other.

23. A device for treating a weft yarn upon stoppage of a shuttleless loom according to claim 19, wherein said auxiliary take up member comprises a nozzle for ejecting compressed air towards said main take up member.

* * * * *